United States Patent [19]

Kim

[11] 4,046,373

[45] Sept. 6, 1977

[54] MULTI-PURPOSE PARALLEL BAR EXERCISING APPARATUS

[76] Inventor: Chong Chan Kim, 1070 Voltaire, Brossard, Quebec, Canada

[21] Appl. No.: 631,116

[22] Filed: Nov. 12, 1975

[51] Int. Cl.[2] ..... A63B 3/00

[52] U.S. Cl. ..... 272/63; 272/144; 272/145

[58] Field of Search ..... 272/112, 113, 78, 109, 272/93, 134, 144, 145, 63, 70, 135, 137, 142

[56] References Cited

U.S. PATENT DOCUMENTS

| | | | |
|---|---|---|---|
| 2,682,402 | 6/1954 | McCarthy | 272/134 |
| 3,118,668 | 1/1964 | Callahan | 272/123 |
| 3,559,986 | 2/1971 | Ehrmantraut | 272/70 X |
| 3,622,164 | 11/1971 | Williams | 272/134 X |
| 3,741,538 | 6/1973 | Lewis et al. | 272/134 |
| 3,787,048 | 1/1974 | Bock | 272/145 |

*Primary Examiner*—Richard J. Apley
*Assistant Examiner*—William R. Browne

[57] ABSTRACT

An exercising device includes an elongated frame having parallel side rails which support a pair of independently movable platforms. The exercising device is also provided with a pair of raised side rails which are parallel to the movable platform supporting rails and which are spanned by immobile padded supports. The base of the exercising device has two separate padded body supports that are freely movable there along.

7 Claims, 10 Drawing Figures

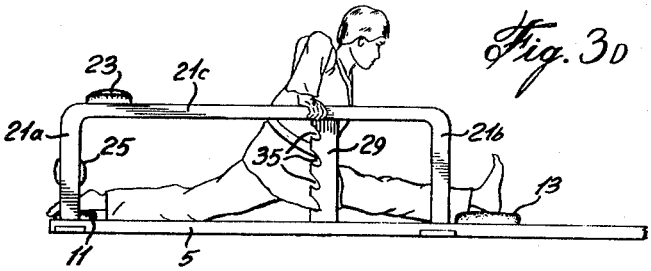
Fig. 3D
Fig. 3E
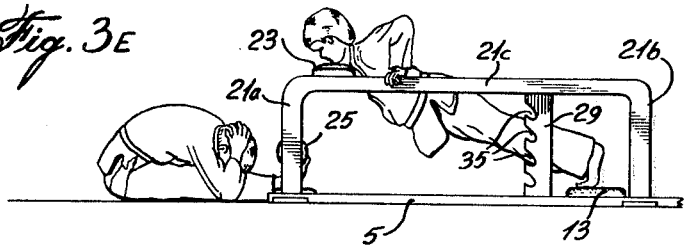
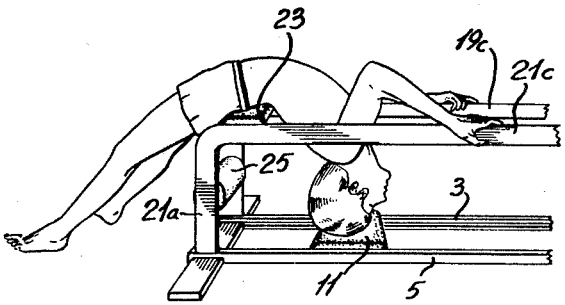
Fig. 3F

MULTI-PURPOSE PARALLEL BAR EXERCISING APPARATUS

BACKGROUND OF THE INVENTION

1. Field of the Invention

This invention relates to a novel exercising apparatus. More specifically, this invention relates to such an apparatus which includes movable support means and is useful for a wide variety of muscle stretching and strengthening exercises.

2. Statement of the Prior Art

Parallel bar exercisers are well known in the art as are muscle stretching exercisers of various shapes and forms. However, the apparatus known in the art are limited in the type and number of exercises which can be practiced on them. In addition, the known exercise apparatus do not include any movable means which permit an exerciser to move into a stretch position with the aid of the movable means.

SUMMARY OF THE INVENTION

It is therefore an object of the invention to provide an exercising apparatus which includes movable means for permitting an exerciser to move into a stretch position.

It is a further object of the invention to provide an exercising apparatus which can be used for a wide variety of muscle stretching and strengthening exercises.

In accordance with the invention, an exercise apparatus comprises:

- a support and guide frame comprising two, spaced, elongated side members and two, spaced, end members respectively joined to form an elongated enclosed area;
- a first rail member mounted on one of said side members and extending longitudinally therealong, said first rail member comprising two vertically upright end members, spaced from each other on said one side member, and a first longitudinal rail member connected to and extending between said vertically upright end members of said first rail members;
- a second rail member mounted on the other one of said side members and extending longitudinally therealong, said second rail member comprising two vertically upright end members, spaced from each other on said second side member, and a second longitudinal rail member connected to and extending between said vertically upright end members of said second rail member; and
- at least one movable support means extending between said two side members and movable along the length of said elongated area.

Preferably, the apparatus comprises two such movable support means.

The movable support means can comprise cloth mats, and can be made movable by rollers in engagement with either a floor surface or an inwardly extending flat surface of said side members, or by rollers on tracks, the rollers comprising circumferential grooves for engaging the tracks, or by low friction engagement of two flat surfaces.

BRIEF DESCRIPTION OF THE DRAWINGS

The invention will be better understood by an examination of the following description, together with the accompanying drawings, in which:

FIGS. 3A, 3B, 3C, 3D, 3E, 3F illustrate the apparatus in use to show how the different elements of the exerciser can be used.

DETAILED DESCRIPTION OF THE DRAWINGS

Figures 1, 2A, 2B, 2C:
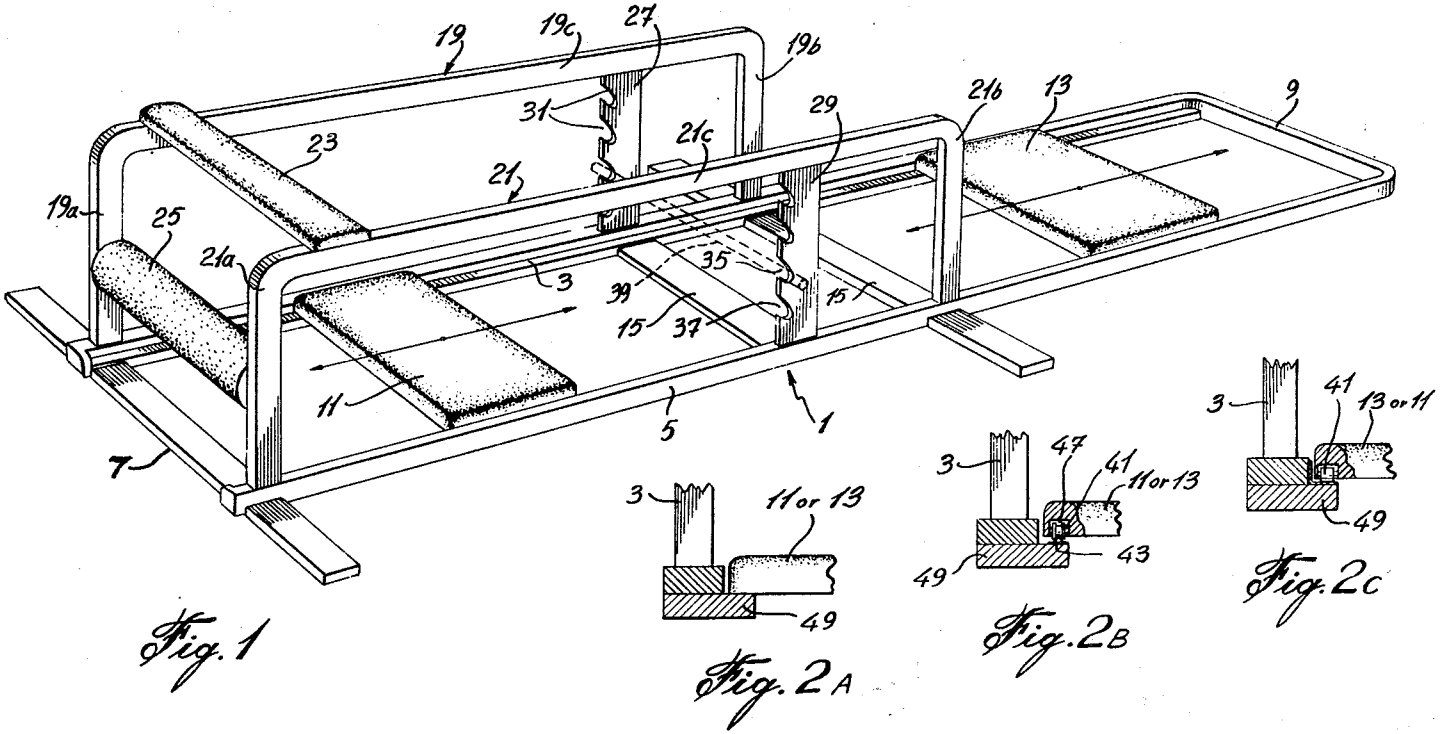
FIG. 1 is a perspective view of the inventive apparatus.
FIGS. 2A, 2B, 2C show several means for making the support means movable.

Referring to FIG. 1, the apparatus comprises a support and guide frame, indicated generally at 1, and including spaced, elongated side members 3 and 5, and spaced end members 7 and 9. The side and end members are respectively connected together to form an elongated enclosed area.

Extending between the side members 3 and 5 are movable support means 11 and 13 which are movable along the length of the elongated enclosed area. The movable means are preferably in mat form and made of a matting material. Although in FIG. 1 the mats are shown extending fully across the enclosed area, it will be appreciated that means having a lesser width can also be employed within the scope of the invention. Means for making the support means movable will be described below with reference to FIG. 2.

Fixed cross member 15 also extends between the side members 3 and 5 and is included to reinforce the frame 1 as required.

Mounted on each of the side members 3 and 5 are rail members 19 and 21 respectively. As can be seen, the rail members extend along their respective side members, and they comprise, respectively, vertically upright members **19*a*, 19*b* and 21*a*, 21*b*** spaced from each other on their respective side members.

Extending between and connected to vertically upright members **19*a* and 19*b* and 21*a* and 21*b* respectively are longitudinal rail members 19*c* and 21*c*. Extending between 19*c* and 21*c*, at one end thereof, is a cross bar 23 which is preferably padded, and extending between 19*a* and 21*a* is a second cross bar 25, also padded, and disposed so that it is spaced from the frame 1**.

Vertically upright rod supports 27 and 29 extend between members 3 and **19*c* and 5 and 21*c* respectively. The rod supports are aligned with each other, and comprise notches 31, 33 and 35, 37 respectively. The notches 31, 35 and 33, 37 are respectively aligned, and are adapted to receive a rod 39 (shown in dotted lines in notches 33, 37**). Because of the plurality of aligned notches in each rod support, the height of the rod is adjustable. It will be appreciated that more than two notches could be included on each rod support.

The apparatus can be made of wood, hollow metal piping, or any other suitable material as well known in the art. The method of construction of such structures is well known and requires no further description here.

Referring now to FIG. 2, the movable support means 11 or 13 can be made movable by providing, at each end thereof, a pair of rollers 41 as shown in FIG. 2A. Only one such roller is shown in FIG. 2C as the second roller on the left hand side is directly behind the roller shown. A similar pair would be included on the right hand side so that the means 11 or 13 would include a roller at each corner of the rectangular mat.

The rollers can roll along the floor of the room in which the apparatus is located, or, as shown in FIG. 2C, along the top of inwardly extending portion 49 of the side members.

In a second embodiment, shown in FIG. 2B, a track 43 is provided on the top surface of the portion 49. A separate track is provided on each side of the apparatus adjacent to members 3 and 5 respectively running the full length of the members and internally of the enclosed area. Four rollers 41 (at each corner of the mat) are again provided, and each roller includes a circumferential groove 47 for engaging the respective tracks as shown in FIG. 2B.

It is also possible to make the support means movable without the use of rollers by providing highly polished low friction engaging surfaces as shown in FIG. *2a.*

FIG. 3 illustrates ways in which the different elements of the inventive apparatus can be utilized. It will be realized that a large number of exercises can be performed on the apparatus, and each of the elements can be put to uses other than shown in FIG. 3. Thus, FIG. 3 is merely illustrative of the type of use to which the elements can be put, but is not exhaustive of either all of the uses of the apparatus or the elements.

Figure 3A:
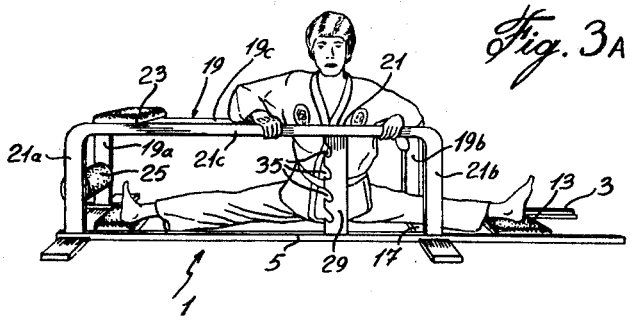

Referring now to FIG. 3A, this illustrates one use for the movable means using both means at the same time. In this use, both movable means are brought together and one foot of an exerciser is placed on one mat while the other is placed on the mat. The mats are then forced apart by the exerciser using the leg muscles until the exerciser is in the position shown in FIG. 3A.

Figure 3B:
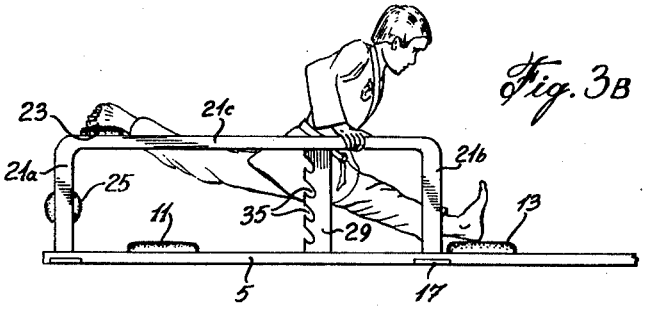
Figure 3C:
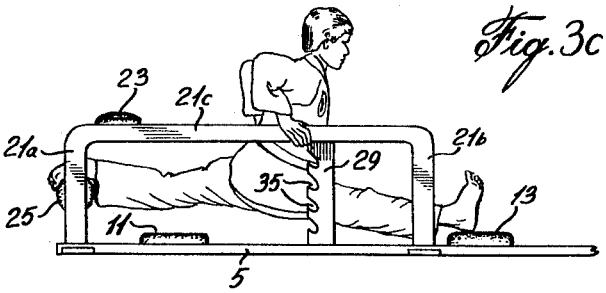

FIG. 3B illustrates how the cross bar 23 could be used in association with the mat 13. A similar arrangement is shown in FIG. 3C except that, in FIG. 3C, the cross bar 25 is used instead of the cross bar 23. As can be seen, with the inventive apparatus it is possible to stretch the legs so that they are at an angle of greater than 180° to each other. In addition, because of the movable mats, the force which is being operated against in the performance of the exercises is the weight of the individual performing the exercises.

One use to which the bar 39 can be put is shown in FIG. 3D. Again, in this illustration, the bar 39 is used in conjunction with the mat 11.

FIG. 3E illustrates another feature of the inventive exercise apparatus, namely its ability to be used by more than one person at a time. In FIG. 3E, the left hand exerciser is using the bar 25 to restrain his feet while doing sit up exercises. The right hand exerciser is doing a combination of push up and leg stretching exercises using rails 19 and 21 and the mat 13. His chin will touch the bar 23 between push ups.

FIG. 3F shows how the bar 23 can be used as a back rest in performing exercises.

As mentioned, only several uses of the elements of the apparatus and the complete apparatus have been demonstrated above. In addition, only one embodiment of the invention was described, and this was for the purpose of illustrating, but not limiting, the invention. Various modifications, which will come readily to the mind of one skilled in the art, are within the scope of the invention as defined in the appended claims.

I claim:

1. An exercise apparatus comprising:

guide frame means, said frame means including a pair of elongated side members, said side members being oriented substantially parallel to one another and being interconnected at their opposite ends by end members, said end members being substantially parallel and cooperating with said side members to define an elongated enclosed area;

first rail means mounted on one of said frame means side members and extending longitudinally therealong, said first rail means including a first pair of spatially displaced upwardly extending legs and a first longitudinal rail connected to and extending between said legs of said first pair, said first longitudinal rail being displaced above said frame means one side member;

second rail means mounted on the other of said frame means side members and extending longitudinally therealong, said second rail means including a second pair of spatially displaced upwardly extending legs and a second longitudinal rail connected to and extending between said legs of said second pair, said second longitudinal rail being generally coplanar and parallel with said first longitudinal rail;

first padded body support means extending between said frame means side members, said first support means being freely movable along said side members;

second padded body support means extending between said frame means side members, said second support means being freely movable along said side members independently of the movements of said first support means whereby the spacing between said body support means may be varied;

a first padded crossbar extending between said first and second rail means, said first padded crossbar being affixed to said first and second longitudinal rails adjacent first ends thereof; and a second padded crossbar extending between said rail means, said second padded crossbar being affixed to the upwardly extending legs of said first and second rail means at said first ends of said rail means.

2. The apparatus of claim 1 further comprising:

first vertical rod support means extending between one of said frame means side members and said first rail means longitudinal rail, said first vertical rod support means including a plurality of spatially displaced notches;

second vertical rod support means extending between the other of said frame means side members and said second rail means longitudinal rail, said second vertical support means including a plurality of spatially displaced notches, the notches of said second vertical rod support means being horizontally aligned with the notches of said first vertical rod support means; and rod means adapted to be received by corresponding notches in said first and second vertical support means whereby the height at which said rod means is disposed is adjustable.

3. The apparatus of claim 2 wherein said movable body support means each further comprise:

a rectangularly shaped member; and roller means disposed at each corner of said rectangularly shaped member at the underside thereof.

4. The apparatus of claim 2 further comprising:

parallel track means, said track means being respectively mounted on said frame means side members and extending substantially the full length of said side members; and wherein said movable body support means each further comprise:

a rectangular member; and a roller disposed at each corner of the underside of said rectangular member, said rollers each including a track means engaging circumferential groove.

5. The apparatus of claim 2 wherein said first and second rail means longitudinal rails are parallel to and of shorter length than said frame means side members, said longitudinal rails being of equal length.

6. The apparatus of claim 1 wherein said first and second rail means longitudinal rails are parallel to and of shorter length than said frame means side members, said longitudinal rails being of equal length.

7. An exercise apparatus comprising:

guide frame means, said frame means including a pair of elongated side members, said side members being oriented substantially parallel to one another and being interconnected at their opposite ends by end members, said end members being substantially parallel and cooperating with said side members to define an elongated enclosed area;

first rail means mounted on one of said frame means side members and extending longitudinally therealong, said first rail means including a first pair of spatially displaced upwardly extending legs and a first longitudinal rail connected to and extending between said legs of said first pair, said first longitudinal rail being displaced above said frame means one side member;

second rail means mounted on the other of said frame means side members and extending longitudinally therealong, said second rail means including a second pair of spatially displaced upwardly extending legs and a second longitudinal rail connected to and extending between said legs of said second pair, said second longitudinal rail being generally coplanar and parallel with said first longitudinal rail;

first padded body support means extending between said frame means side members, said first support means being freely movable along said side members;

second padded body support means extending between said frame means side members, said second support means being freely movable along said side members independently of the movements of said first support means whereby the spacing between said body support means may be varied;

first vertical rod support means extending between one of said frame means side members and said first rail means longitudinal rail, said first vertical rod support means including a plurality of spatially displaced notches;

second vertical rod support means extending between the other of said frame means side members and said second rail means longitudinal rail, said second vertical support means including a plurality of spatially displaced notches, the notches of said second vertical rod support means being horizontally aligned with the notches of said first vertical rod support means; and rod means adapted to be received by corresponding notches in said first and second vertical support means whereby the height at which said rod means is disposed is adjustable.

* * * * *